US009980589B2

(12) United States Patent
Piccinini

(10) Patent No.: US 9,980,589 B2
(45) Date of Patent: May 29, 2018

(54) PLATE

(71) Applicant: Carlo Piccinini, Leeds (GB)

(72) Inventor: Carlo Piccinini, Leeds (GB)

( * ) Notice: Subject to any disclaimer, the term of this patent is extended or adjusted under 35 U.S.C. 154(b) by 0 days. days.

(21) Appl. No.: 15/039,559

(22) PCT Filed: Nov. 27, 2014

(86) PCT No.: PCT/GB2014/053511
§ 371 (c)(1),
(2) Date: May 26, 2016

(87) PCT Pub. No.: WO2015/079234
PCT Pub. Date: Jun. 4, 2015

(65) Prior Publication Data

US 2017/0156528 A1 Jun. 8, 2017

(30) Foreign Application Priority Data

Nov. 29, 2013 (GB) ..... 1321134.7

(51) Int. Cl.
*A47G 23/06* (2006.01)

(52) U.S. Cl.
CPC ..... *A47G 23/0641* (2013.01)

(58) Field of Classification Search
CPC ..... A47G 23/0641; A47G 23/0625; A47G 23/06; A47G 19/06; A47G 23/065
USPC ..... 206/553, 426; 220/556; 294/172
See application file for complete search history.

(56) References Cited

U.S. PATENT DOCUMENTS

| | | | | | |
|---|---|---|---|---|---|
| 1,953,933 | A * | 4/1934 | Gundelach | A47G 23/0625 | 294/172 |
| 2,295,860 | A | 9/1942 | Oliver | | |
| 4,219,144 | A | 8/1980 | Hagelberg | | |
| 4,461,396 | A * | 7/1984 | Harper | A47G 19/065 | 206/565 |
| 5,111,960 | A | 5/1992 | Zilliox | | |
| 5,114,038 | A * | 5/1992 | Laumann | A47G 19/065 | 220/23.83 |
| 5,152,398 | A * | 10/1992 | Forestal | A47G 19/065 | 206/561 |
| 5,294,000 | A * | 3/1994 | Yanuzzi | A47G 19/065 | 206/519 |

(Continued)

FOREIGN PATENT DOCUMENTS

| | | |
|---|---|---|
| CN | 201243895 Y | 5/2009 |
| DE | 1832770 U1 | 3/1979 |

(Continued)

OTHER PUBLICATIONS

The International Search Report as dated Mar. 23, 2015 for International Application No. PCT/GB2014/053511.

(Continued)

*Primary Examiner* — Steven A. Reynolds
(74) *Attorney, Agent, or Firm* — Quarles & Brady LLP

(57) ABSTRACT

A generally planar plate (1) for supporting food and drink is disclosed. The plate (1) including an oblong opening (2) relative to the major axis of the plate and through which the thumb may extend to grip the top of the plate (1) and by which the bottom of the plate (1) can be gripped by the splayed apart fingers of the hand of the user, to thereby provide a stable surface for supporting food and drink on top of the plate (1).

4 Claims, 2 Drawing Sheets

(56) References Cited

U.S. PATENT DOCUMENTS

| | | | | | |
|---|---|---|---|---|---|
| 5,390,798 | A * | 2/1995 | Yanuzzi | A47G 19/065 | 206/519 |
| 5,429,266 | A * | 7/1995 | D'Oliveira | A47G 19/065 | 206/564 |
| 5,551,593 | A * | 9/1996 | Wiens | A47G 19/06 | 220/238 |
| 5,607,077 | A * | 3/1997 | Torkelson | A47G 19/065 | 206/217 |
| 5,947,011 | A * | 9/1999 | Xu | A47G 19/065 | 206/557 |
| 6,129,235 | A * | 10/2000 | Creske | A47G 19/065 | 206/549 |
| 7,000,799 | B1 * | 2/2006 | Hamre | A47G 19/065 | 220/23.8 |
| D563,726 | S * | 3/2008 | Fraser | D7/553.1 | |
| D595,093 | S * | 6/2009 | McComas | D7/546 | |
| D650,237 | S * | 12/2011 | McComas | D7/546 | |
| 2009/0120832 | A1 | 5/2009 | Munden | | |
| 2014/0339116 | A1 * | 11/2014 | Chiorazzi | A47G 23/0625 | 206/426 |

FOREIGN PATENT DOCUMENTS

| | | |
|---|---|---|
| DE | 20 2008 013029 | 12/2008 |
| FR | 2532833 A1 | 3/1984 |
| FR | 2838317 A1 | 10/2003 |
| FR | 2 847 447 | 5/2004 |
| GB | 1 126 304 | 9/1968 |
| JP | S63 110272 | 7/1988 |
| JP | H0389670 U | 9/1991 |

OTHER PUBLICATIONS

PCT International Preliminary Report on Patentability, PCT/GB2014/053511, dated Jun. 9, 2016, 6 pages.

Intellectual Property Office, Search Report, Application No. GB1321134.7, dated Oct. 15, 2014, 2 pages.

* cited by examiner

PLATE

CROSS-REFERENCE TO RELATED APPLICATIONS

This application represents the national stage entry of PCT International Application No. PCT/GB2014/053511 filed on Nov. 27, 2014 and is based upon and claims the benefit of priority from British Patent Application No. 1321134.7, filed on Nov. 29, 2013, the entire contents of all of which are incorporated herein by reference.

This invention relates to a plate for carrying food and drink, particularly, but not exclusively, for use when entertaining guests at a party or reception.

A well-known problem at parties where food and drink is available to guests is that two hands are usually needed to safely carry a plate of food and a drink, such as a glass of wine. This makes it difficult to shake the hands of other guests at the party and it is common in such circumstances for guests to put down the plate or the glass of wine or other drinks' container to formally greet another guest by means of a handshake, sometimes leading to confusion as to whose plate or whose drink has been placed where. Particularly where the party is a large one such as in the form of a reception for a business networking event, it is often the case that there is little spare room available in the immediate vicinity of pairs of such guests within the room where the party is being held. This is an inconvenient problem and can lead to awkward and embarrassing situations where food and drink is spilt or dropped by, for example, transferring a glass of wine to the same hand holding a plate for the purposes of allowing the other hand to be used for a handshake.

Food plates or trays are known which include apertures for receiving part of a thumb to help stabilise the tray or plate but, in use, when food and/or drink are being supported the user experience is very uncomfortable because the plate or tray acts as a hinge with the thumb as its pivot point, the arrangement therefore becoming very unstable over time.

The present invention is derived from the realisation that there is a need for a simple and effective way to overcome the aforesaid problems and, which addresses the ergonomic disadvantages of the prior art.

According to the invention, there is provided a plate for supporting food and drink, the plate comprising a substantially planar receiving surface for supporting food and drink, an elongate opening formed within the receiving surface, the elongate opening comprising a major axis which extends along a length of the opening and through which a thumb of a user may extend to grip a top of the receiving surface, and by which a bottom of the receiving surface can be gripped by the splayed apart fingers of the hand of the user to thereby provide a stable surface for supporting food and drink, the plate further comprising a substantially circular aperture disposed proximate an edge of the receiving surface and an elongate slot which extends from the aperture out through the edge of the receiving surface along which a stem of a wine glass may pass, so that a top half of the wine glass can be supported by the plate within the circular aperture with the stem of the wine glass depending below it, wherein the substantially circular aperture and slot are aligned along the major axis of the elongate opening such that the plate is substantially symmetric about the major axis.

With this arrangement the whole of a thumb of a user of the plate is able to extend over the top of it, thereby allowing the fingers of the hand to become splayed apart to support the central part of the underside of the plate in a comfortable and stable manner.

In an embodiment, the elongate opening is completely surrounded by the receiving surface to form an elongate aperture. In this embodiment, the elongate aperture comprises a first radius of curvature at a first end thereof and a second radius of curvature at a second end thereof. The elongate aperture is orientated such that the first end of the elongate aperture is disposed closer to the substantially circular aperture than the second end and the first radius of curvature is preferably greater than the second radius of curvature.

In an alternative embodiment, the elongate opening comprises an elongate indentation in the side of the plate of shape sufficient to allow the thumb to be captured by it for the purposes of acting in unison with the splayed-apart fingers of the user of the plate to support it, in use. In this embodiment, the indentation preferably widens in a direction which is inwardly of the receiving surface.

Advantageously, the plate, which expression also includes a tray, may include a continuous upstanding rim around a periphery of the receiving surface, acting to prevent or inhibit food or drink from being dropped or spilt from the receiving surface, as the case may be.

The invention will now be described, by way of example only, with reference to the accompanying drawings in which.

Figure 1:
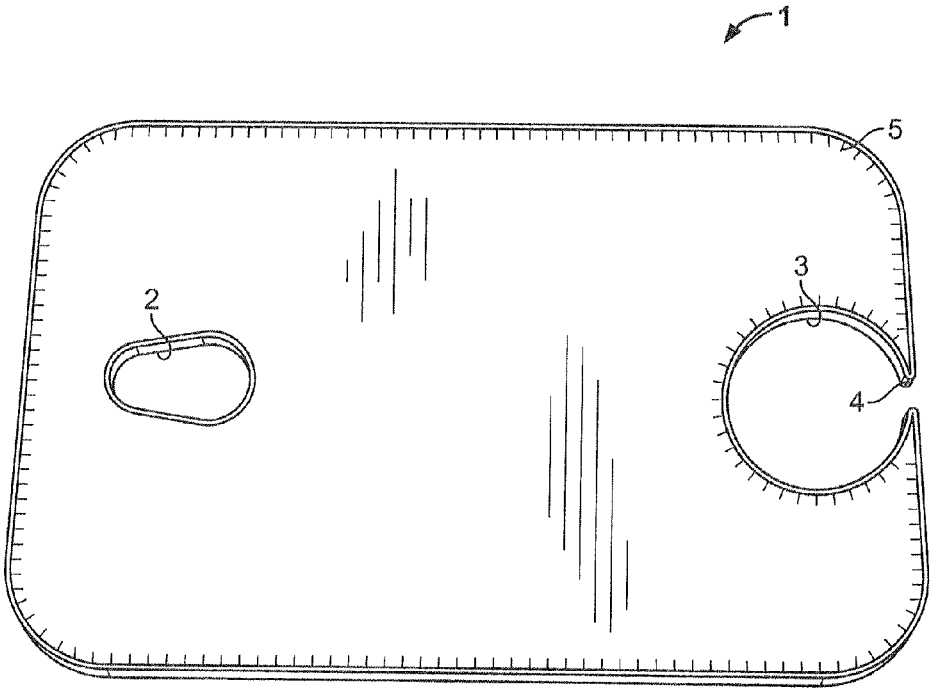
FIG. 1 is a plan view of a party plate according to the invention.

Referring firstly to FIG. 1, a plate shown generally at 1 includes a substantially planar receiving surface for supporting food and drink. The plate 1 further comprises an elongate opening 2 through which a thumb of the user of the plate 1 can be inserted, the elongate opening 2 comprising a major axis which extends along the length of the opening 2. The elongate opening 2 illustrated in FIG. 1 is completely surrounded by the receiving surface and thus in this embodiment comprises an elongate aperture 2 formed within the receiving surface. The plate 1 further comprises a generally circular aperture 3 into which a drinks' container such as a wine glass (not shown) may be inserted. In order to further facilitate this in the case of a wine glass having a conventional stem and foot, the plate 1 is provided with a wine glass-slot 4 for receiving the stem by which the top part of the wine glass is firmly supported in the circular aperture by the plate 1 with the wine glass stem and foot depending from the underside of the plate 1. Extending around the entire periphery of the plate 1 is a continuous rim 5 which, in use, may be used to prevent or inhibit e.g., crumbs of food or droplets of spilt wine from falling off the plate 1.

The circular aperture 3 and slot 4 are orientated along the major axis of the elongate aperture 2, which is substantially collinear with an axis of symmetry of the receiving surface, such that the plate 1 is substantially symmetric about the major axis. The elongate aperture 2 comprises a first and second end thereof centred along the major axis of the aperture 2. The first end of the aperture 2 is disposed closer to the substantially circular aperture 3 than the second end and comprises a radius of curvature which is greater than the radius of curvature at the second end. This difference in aperture size along the major axis is found to accommodate the users thumb most comfortably and provides an intimate fit with the users thumb to improve the stability of the plate 1 in use.

In an alternative embodiment, which is not illustrated, the elongate opening 2 is not completely surrounded by the receiving surface and extends out through a side edge of the receiving surface to form an indentation or notch (not shown) within the plate 1. The further features of the plate 1 of this alternative embodiment comprise those described above with reference to FIG. 1. The indentation similarly comprises a major axis along which the circular aperture 3 and slot 4 are orientated to provide for a symmetric plate 1 about the major axis. In addition, the indentation widens in a direction which is inwardly of the receiving surface to provide for a similar intimate fit around the users thumb as the elongate aperture 2 disclosed in FIG. 1.

Figure 2:
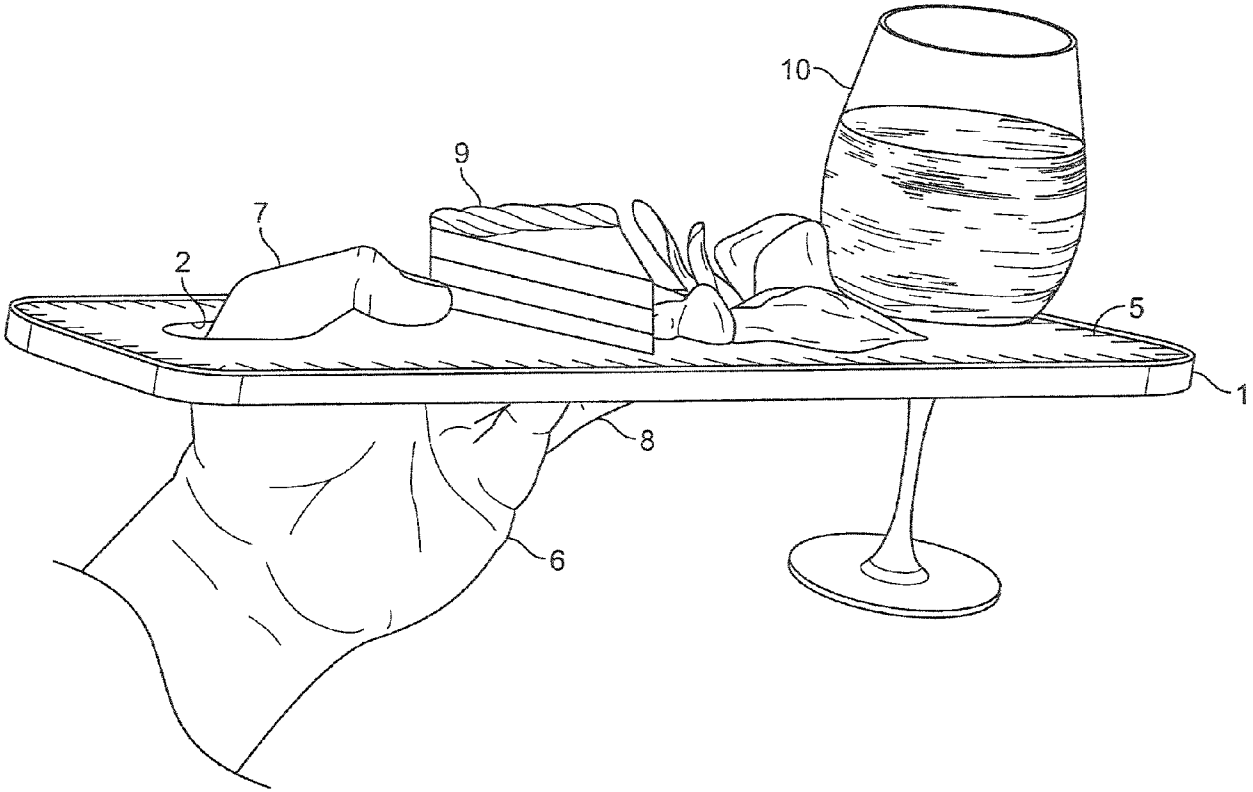
FIG. 2 is a side view of the party plate of the invention, in use.

In FIG. 2, the plate 1 illustrated in FIG. 1 is shown in use where it can be seen that the hand 6 of the user of the plate 1 is supporting it by the combination of the thumb 7 extending through the elongate aperture 2 which thereby captures the thumb to allow it to grip the top surface of the receiving surface of the plate 1 immediately above the splayed fingers 8 of the user of the plate 1. With this ergonomically comfortable arrangement, items of food 9 and a drinks' container such as a wine glass 10 can be easily and safely carried on the receiving surface of the plate 1, even though it is supported only by one hand, thereby allowing the other hand of the user to be used for other purposes, such as formally greeting guests by means of a traditional handshake.

This elegantly simple solution to a common problem also lends itself to opportunities for using the receiving surface of the plate 1 as a marketing or educational tool by carrying branding and/or useful information to the user of the plate including e.g. a guest list, safety instructions in the event of a fire, advertising, and so on. In addition, because the plate is generally planar, it can easily be formed of compression-moulded plastics or other suitable materials including recycled plastics and recyclable materials such as corrugated cardboard. The concept can also be adapted for the fast food market with the plate 1 including further apertures for receiving flanged containers of e.g. food and sauces chosen for use with the food. Thus, the invention in a second aspect also extends to a packaged item of fast food including a party plate according to the invention.

What is claimed is:

1. A plate for supporting food and drink, the plate comprising:

a substantially planar receiving surface for supporting food and drink;

an elongate opening formed within the receiving surface, the elongate opening including a major axis extending along a length of the opening and through which a thumb of a user may extend to grip a top of the receiving surface, and by which a bottom of the receiving surface can be gripped by the splayed apart fingers of the hand of the user to thereby provide a stable surface for supporting food and drink, wherein the elongate opening is completely surrounded by the receiving surface to form an elongate aperture therein;

a substantially circular aperture disposed proximate an edge of the receiving surface; and an elongate slot extending from the substantially circular aperture out through the edge of the receiving surface along which a stem of a wine glass may pass, so that a top half of the wine glass can be supported by the plate within the circular aperture with the stem of the wine glass depending below it, wherein the substantially circular aperture and slot are aligned along the major axis of the elongate opening such that the plate is substantially symmetric about the major axis.

2. A plate according to claim 1, wherein the elongate aperture includes a first radius of curvature at a first end thereof and a second radius of curvature at a second end thereof.

3. A plate according to claim 2, wherein the elongate aperture is orientated such that the first end of the elongate aperture is disposed closer to the substantially circular aperture than the second end, and the first radius of curvature is greater than the second radius of curvature.

4. A plate according to claim 1, further including a continuous upstanding rim around a periphery of the receiving surface, acting to prevent or inhibit food or drink from being dropped or spilt from the receiving surface.

* * * * *